United States Patent [19]

Mardon

[11] Patent Number: 4,899,267

[45] Date of Patent: Feb. 6, 1990

[54] SPOTLIGHT AND CONTROL SYSTEM THEREFOR

[75] Inventor: Paul F. Mardon, Fulbourn, Great Britain

[73] Assignee: Pulsar Light of Cambridge Ltd, Cambridge, England

[21] Appl. No.: 290,363

[22] Filed: Dec. 29, 1988

[30] Foreign Application Priority Data

Mar. 9, 1988 [GB] United Kingdom ..... 8805581
Apr. 19, 1988 [GB] United Kingdom ..... 8809216

[51] Int. Cl.[4] ..... F21V 11/08

[52] U.S. Cl. ..... 362/277; 362/233; 362/321; 362/284; 340/825.06; 340/310 R; 318/696; 318/685

[58] Field of Search ..... 362/277, 280, 281, 282, 362/283, 284, 285, 286, 287, 319, 321, 804, 233; 340/176, 310 A, 310 R, 825.06, 825.62, 825.69, 825.72; 318/16, 625, 685, 696; 315/292

[56] References Cited

U.S. PATENT DOCUMENTS

| | | | |
|---|---|---|---|
| 3,898,643 | 8/1975 | Ettinger | 362/233 |
| 4,156,866 | 5/1979 | Miller | 340/825.06 |
| 4,392,187 | 7/1983 | Bornhorst | 362/233 |
| 4,697,227 | 9/1987 | Callahan | 362/233 |
| 4,720,726 | 1/1988 | Sato et al. | 318/696 |
| 4,757,245 | 7/1988 | Ayers et al. | 318/685 |
| 4,812,727 | 3/1989 | Sakai et al. | 318/696 |

*Primary Examiner*—James C. Yeung
*Assistant Examiner*—D. M. Cox
*Attorney, Agent, or Firm*—Lee, Mann, Smith, McWilliams & Sweeney

[57] ABSTRACT

A multifunction spotlight and control system therefor, the spotlight functions each being adjustable by a bipolar stepper motor, a control means such as a dimmer unit for enabling analogue control of the rotational positions of the motors, and a second control means such as a microprocessor which enables a multichannel serial datastream to be supplied for selectively controlling the motors.

10 Claims, 12 Drawing Sheets

SHEET 1

SHEET 2
TEXT IN BRACKETS REFER TO 27C16 PIN OUT
+5V
C11
.47N
IC3 27C16 OR 27C64
108
EPROM
VPP
A12
A7
A6
A5
A4
A3
A2
A1
A0
O0
O1
O2
VSS
VCC
PGM
NC
A8
A9
A11
OE
A10
CE
O7
O6
O5
O4
O3
26 (VCC)
23 (VPP)
0V
136
LATCH
IC2 74HC733
VDD
D7
D6
D5
D4
E
EO
D0
D1
D2
D3
FROM FIG.10 SHEET 1
FROM FIG.10 SHEET 1

SHEET 1

SHEET 2

SPOTLIGHT AND CONTROL SYSTEM THEREFOR

FIELD OF THE INVENTION

This invention concerns remotely controlled multifunction spotlights and control systems therefor by which one or more such spotlights can be controlled from a remote console.

BACKGROUND TO THE INVENTION

Remotely controlled multifunction spotlights and a control system for such lights is described in U.S. Pat. No. 4,392,187, by which the colour and position of the beam from each of a number of spotlights in a system, can be controlled from a single control console. In common with other lighting control systems such as that described in earlier U.S. Pat. No. 4,095,139, the system in 4,392,187 uses a single transmission path between the control console and the spotlights in the system, and serial data streams, each having a precursor which is only recognised by one of a plurality of data receivers associated with the spotlights, so that serial data for controlling the different spotlights can be routed automatically to the appropriate spotlight, via its associated receiver, without causing any response in the other spotlights.

Such systems have the advantage that only a single conductor pair is needed around the entire system to convey the digital control signals to the various control devices within the different spotlights. There is thus a considerable saving in the amount of cabling required to set up and interconnect the lights—but the spotlights concerned are not suitable for control by analogue control signals such as may be obtained from a mixing desk or console, a number of potentiometers, usually in the form of linear potentiometers, each having a sliding control for adjusting the output voltage/current from a minimum to a maximum value, as required.

In an analogue system, if six functions are to be controlled in each light, the control signals from six potentiometers will need to be supplied to each light by way of for example a six core cable with a common return path which may double up as one of the conductive paths providing operating current for the lamp.

There are many existing installations which can produce analogue signals as a large number of separate channels. Complete with control console and wiring. However it is often desirable to be able to update or replace some of the spots, to enable special effects to be produced or to extend such systems by the addition of new spotlights, and it is one object of the present invention to provide an improved multifunction spotlight which can be controlled from either a multichannel analogue control system or a single wire serial data digital control system. In this way new spotlights can be added to an exisiting system in the full knowledge that if and when the multichannel console is replaced by a digital console, these new spotlights can still be employed in the new system.

It is a further object of the invention to provide an improved multifunction spotlight for use with either type of control system, by which N facilities can be controlled using only n channels of control signals (N being greater than n)—either analogue or digital.

It is a still further object of the invention to provide an improved multifunction spotlight having controllable parameters such as beam position and colour, which can be controlled from a conventional multi-channel lighting control console of the type previously only designed to provide one analogue control signal to an appropriate fader to vary the light intensity of each of a plurality of spotlights.

It is a further object to provide a control system for the currents to a bipolar stepper motor to enable the transistions between stable postions of the armature to be achieved smoothly.

SUMMARY OF THE INVENTION

According to one aspect of the invention in a spotlight having n adjustable parameters (such as beam position and colour), each of which is adjustable by a biopolar electric stepper motor mounted within the spotlight housing, there is provided a first control signal input for the spotlight by which n different analogue electrical signals may be used to control the rotational position of the n different stepper motors, to allow remote control of the n different parameters, and a second control signal input by which a single transmission path carrying control signals as a serial datastream can be connected to the spotlight, and receiver means is provided associated with the second signal input adapted only to respond to one particular data stream precursor, so that the spotlight may be uniquely addressed from a remote control, which in known manner generates the appropriate precursor and transmits thereafter the requisite data as a serial data stream to alter one or another or all of the n controllable parameters of the spotlight, by using n different channels within the transmitted data.

Where the parameter controlling drives in the spotlight required analogue signals for their control, the interface typically includes digital to analogue converter circuit means for generating appropriate analogue signal values from the incoming digital data.

Where digital signals are required to control the parameter drives within the spotlight, analogue to digital converter circuit means may be provided to convert the incoming analogue signals on the n different control channels into digital signals.

In accordance with a further aspect of the invention selection circuit means is provided so that if signals are received at both the analogue and serial data inputs, for a given parameter drive, the higher value is always selected and employed to determine the rotational position of the particular parameter drive.

Typically the analogue signal input range required to obtain the complete range of values of each of the controllable parameters, is a voltage change from between 0 V and 10 V. In this way each parameter drive can be controlled by a 0–10 V analogue output from a multichannel control console of the type commonly found in theatres for controlling the intensity of a corresponding number of conventional spotlights via a bank of dimmers, there being one dimmer for each lamp and one control on the console associated with one of the dimmers—and thereby the associated lamp.

According to a further aspect of the invention, in a spotlight adapted to be remotely controlled from a console by the transmission of electrical control signals thereto for controlling, inter alia, the movement of a parameter controlling element in the spotlight, from a first position to a second position, the drive for the element is actuated to move the element into the first position at values near to and at one extreme of the possible range of values of the control signal on the channel appropriate to that parameter, and into its second position by values at or near the other extreme of the possible range of values of the control signal for that channel, and circuit means is provided within the spotlight to detect intermediate values of the incoming signal and the rate of change of the signal values, thereby to generate a supplementary control signal if during said intermediate range of values the rate of change of value falls below a preselected rate for a preselected period of time, and a drive means in the light is adpated to be responsive to the intermediate values of the incoming control signal only when the said supplementaey control signal is generated, whereby that drive means is caused to perform a further controllable function within the spotlight whilst the incoming signal dwells in the said intermediate range of values, depending on the actual intermediate value which is received.

The drive means which is rendered responsive to the intermediate signal values may be the self same drive to which the channel relates, the generation of the supplementary control signal causing the said drive to perform in a different way.

Alternatively the drive controlled by the said intermediate values may be a totally separate drive, for another function, only energised when the supplementary control signal is generated.

In a particularly preferred embodiment the element is a shutter which is movable into and out of the path of the beam and in the presence of the supplementary control signal, the shutter drive is caused to oscillate the shutter between its two extreme positions at a speed determined by the actual intermediate value of the control signal. In this way the spotlight may be made to strobe at a variable strobe frequency determined by the selected value in the intermediate range of values.

According to a further aspect of the invention the transistion between two adjacent positions of the armature of a bipolar stepper motor, may be rendered more smooth than hitherto, by gating the changing one of the two currents at a high frequency such that there are M gated periods between the first position and the second position, and successively increasing the proportion of each gated period during which the changing current is at its new value and thereby decreasing the proportion of each interval during which the changing current is at its initial value, so that if the motor could respond, the armature would perform a series of M oscillations between the first and second positions, with the dwell time at and just after the beginning of the sequence tending towards the first position and the dwell time towards the end of the sequence tending more and more towards the second position.

The invention will now be described by way of example with reference to the accompanying drawings in which.

Figure 10:
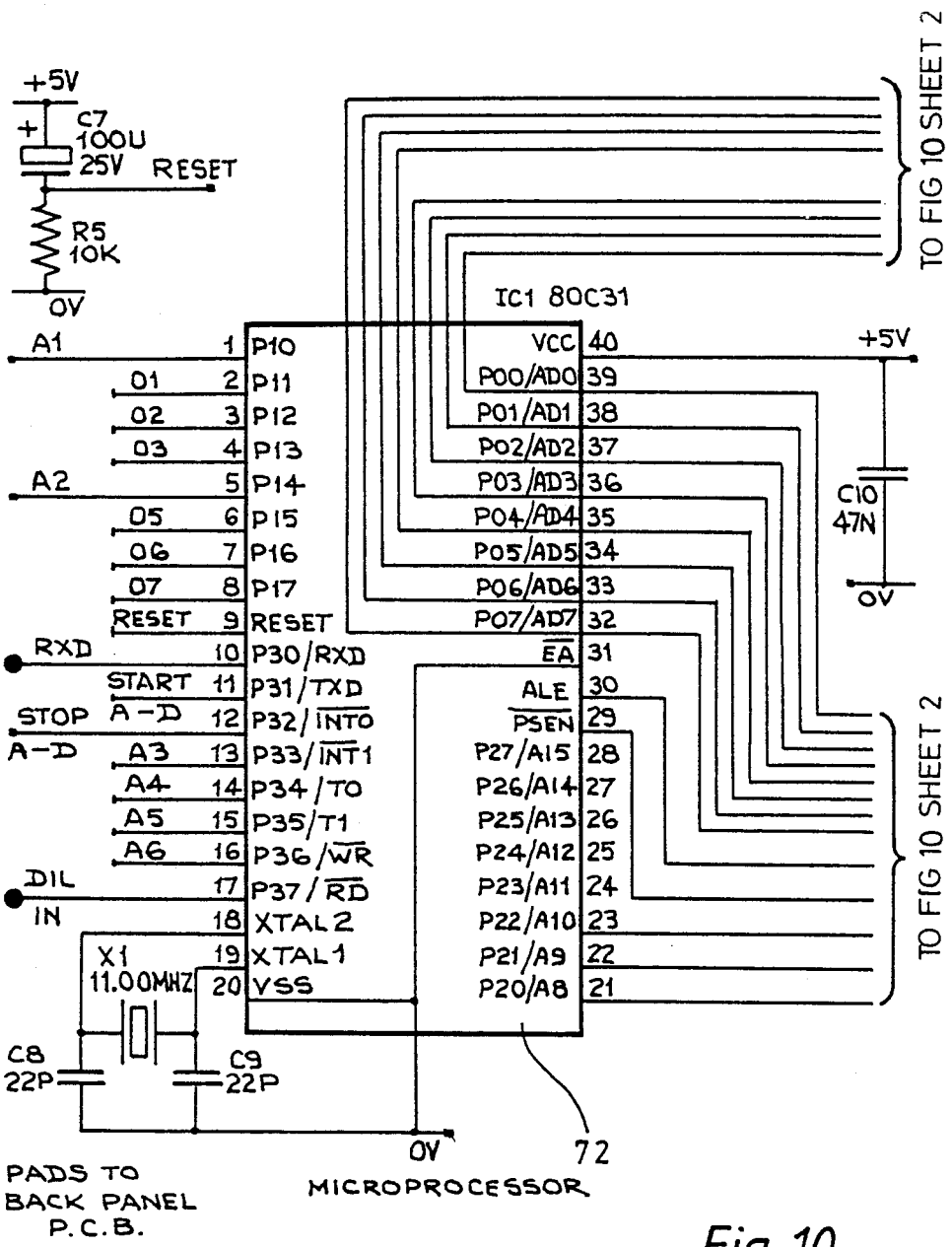
Figure 10:
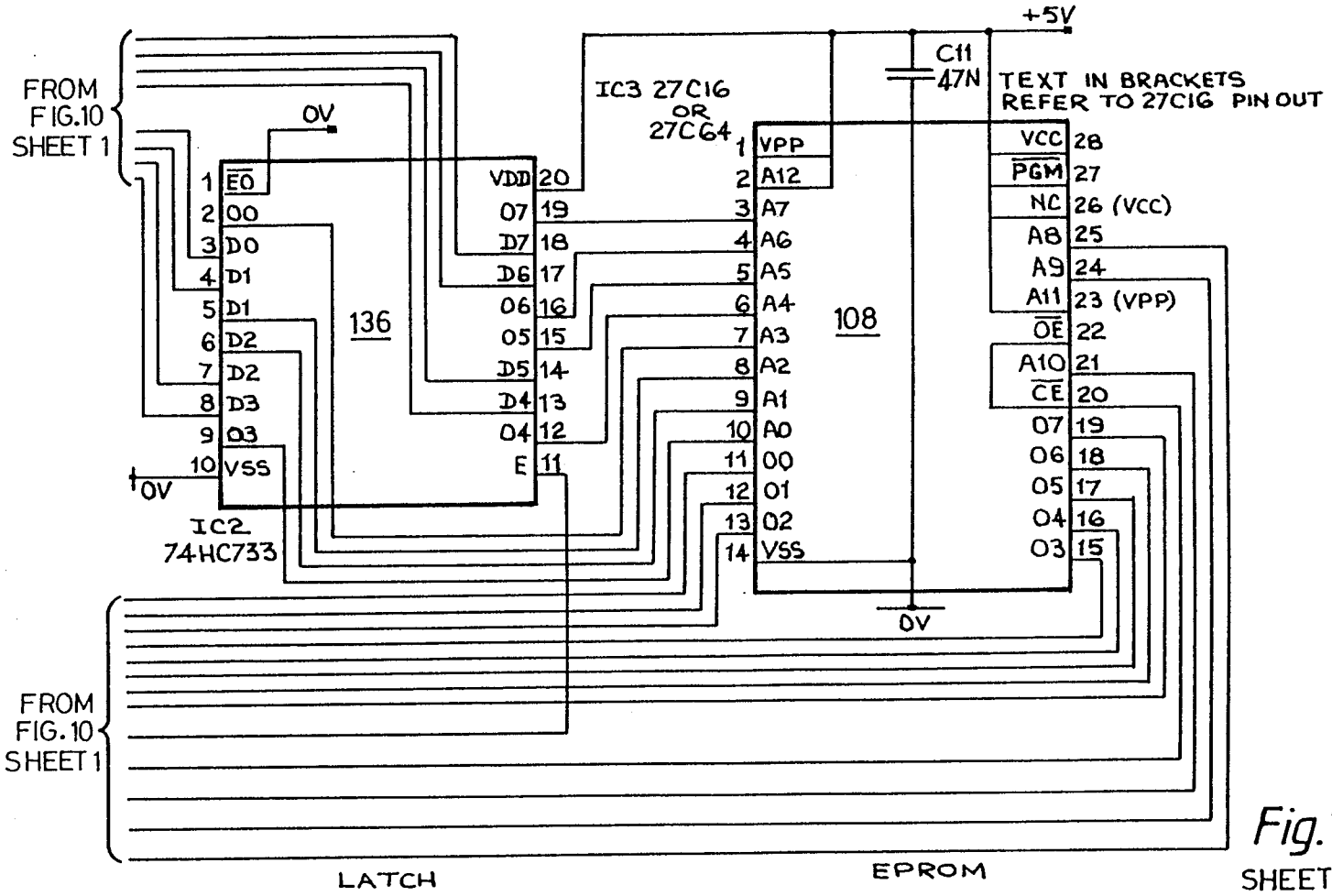
Figure 11:
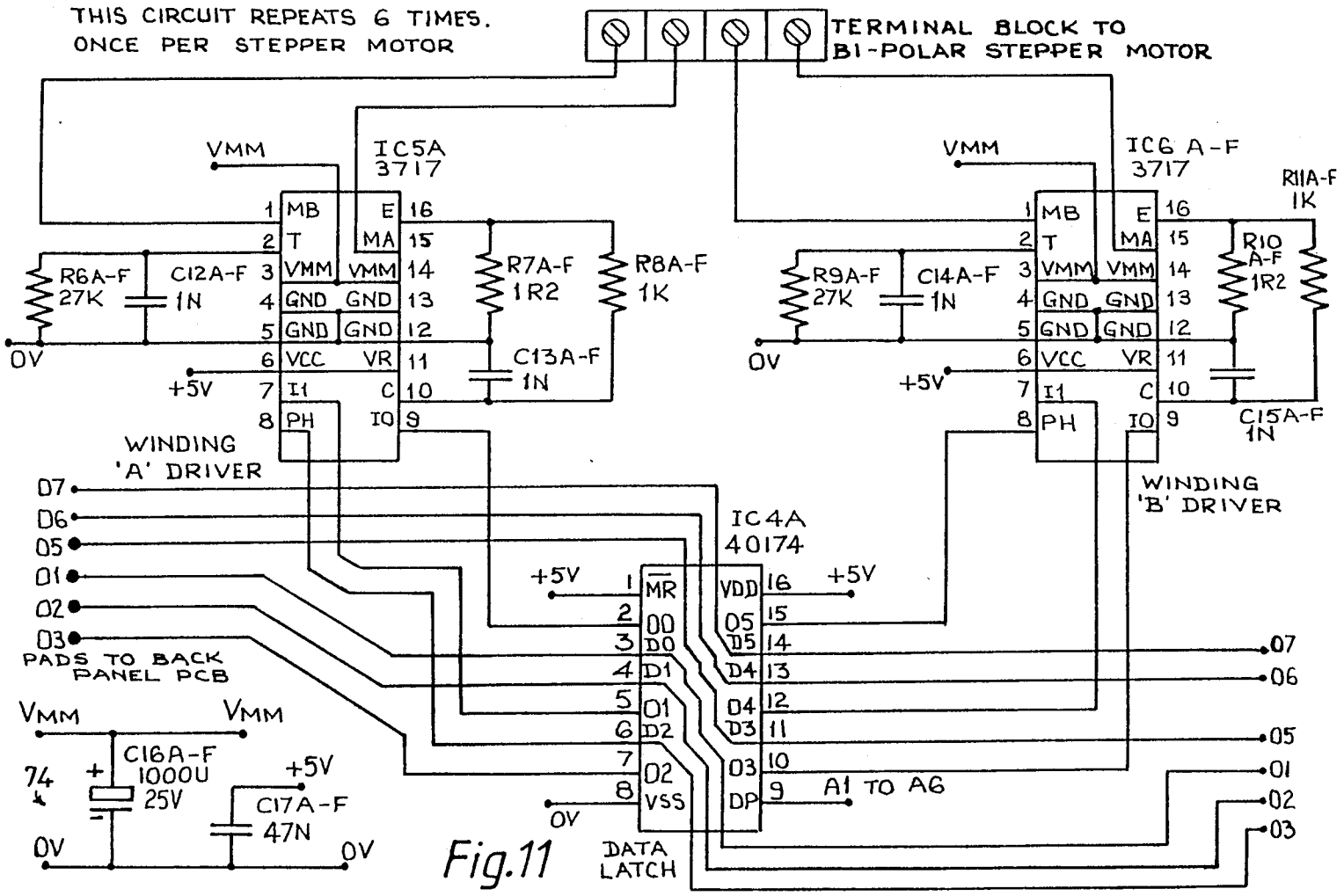
Figure 12:
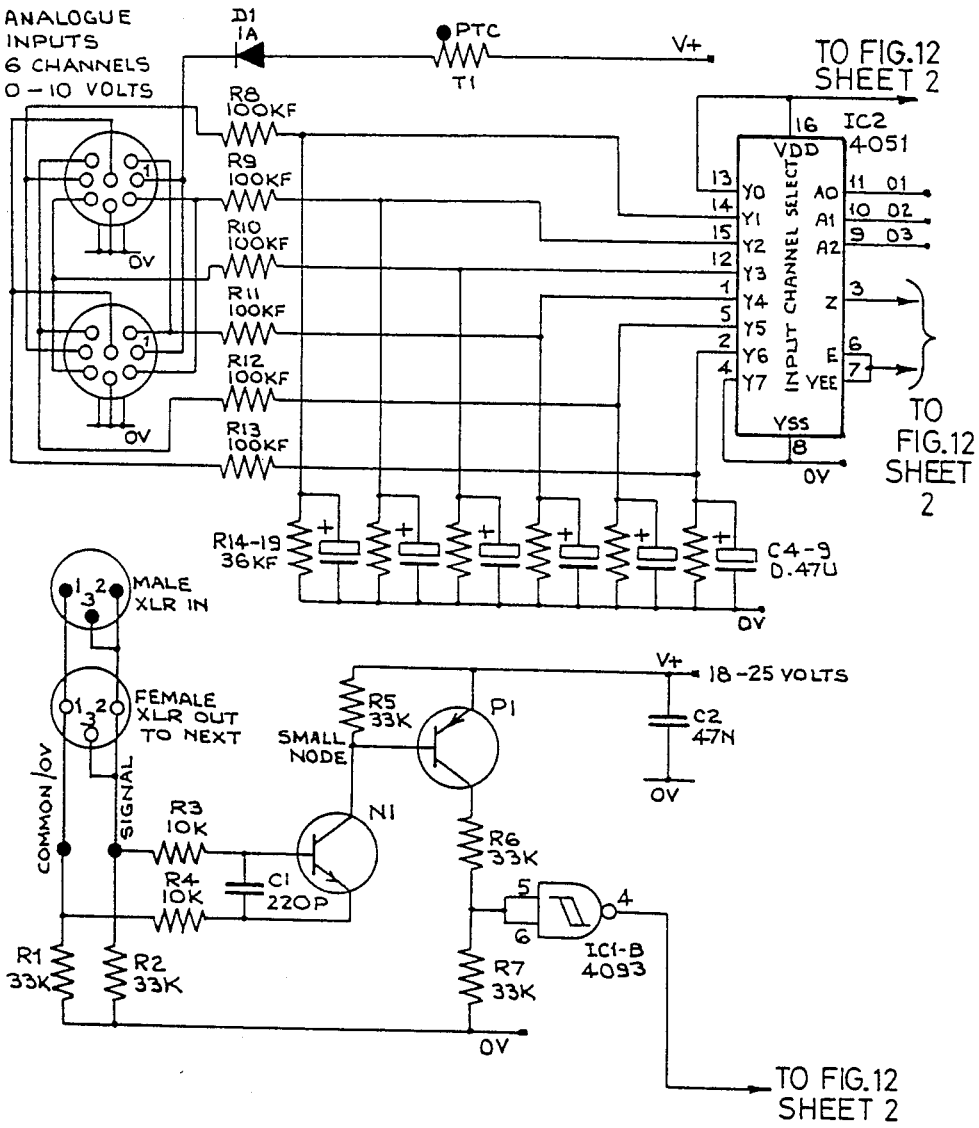
Figure 12:
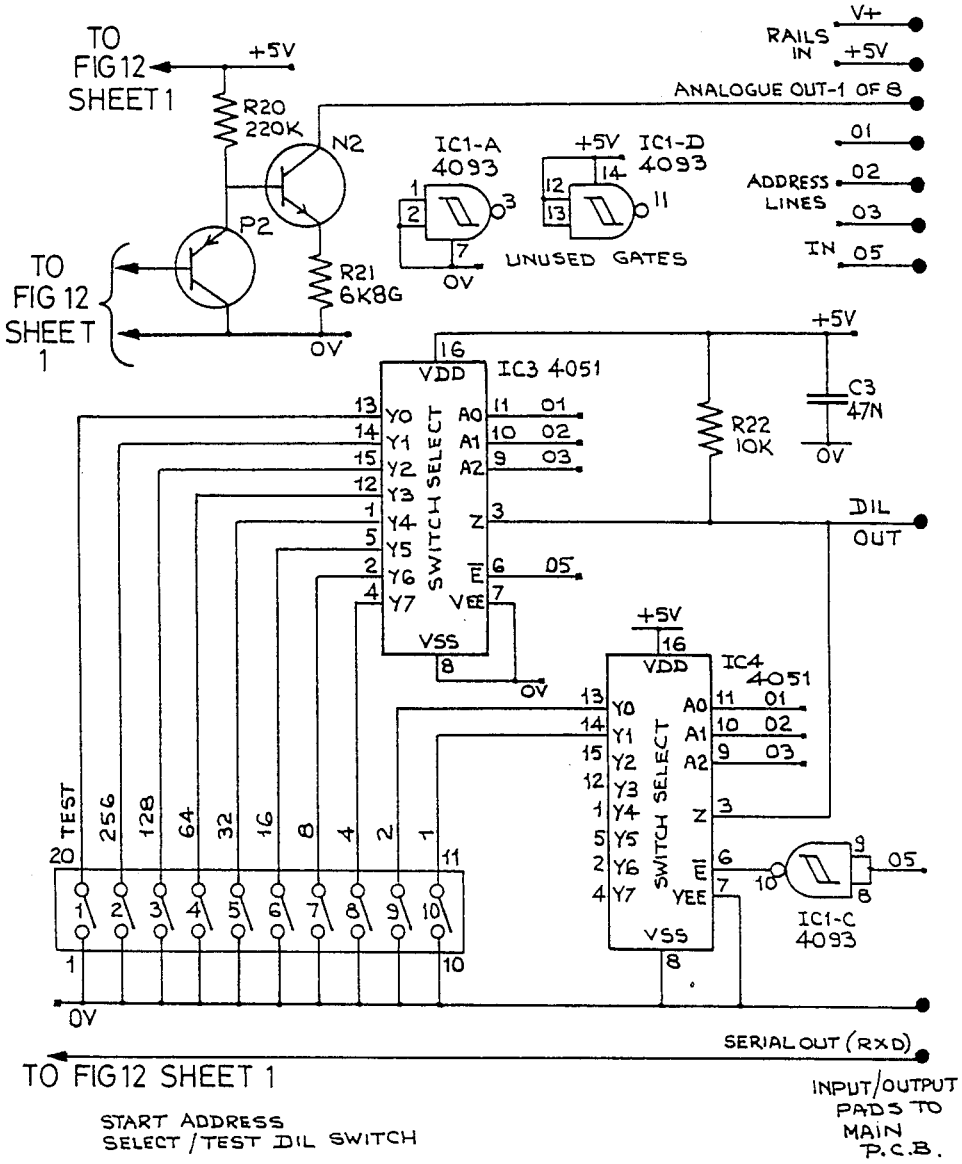

FIG. 10 gives details of the microprocessor latch and EPROM used in the control circuit;

FIG. 11 is one of six similar circuits for driving the six different motors of the spotlight;

FIG. 12 shows details of the circuits contained on a back panel printed circuit board within the spotlight and in particular shows how the address for the spotlight can be selected, and how incoming digital analogue information signals are processed.

DETAILED DESCRIPTION OF DRAWINGS

Figure 1:
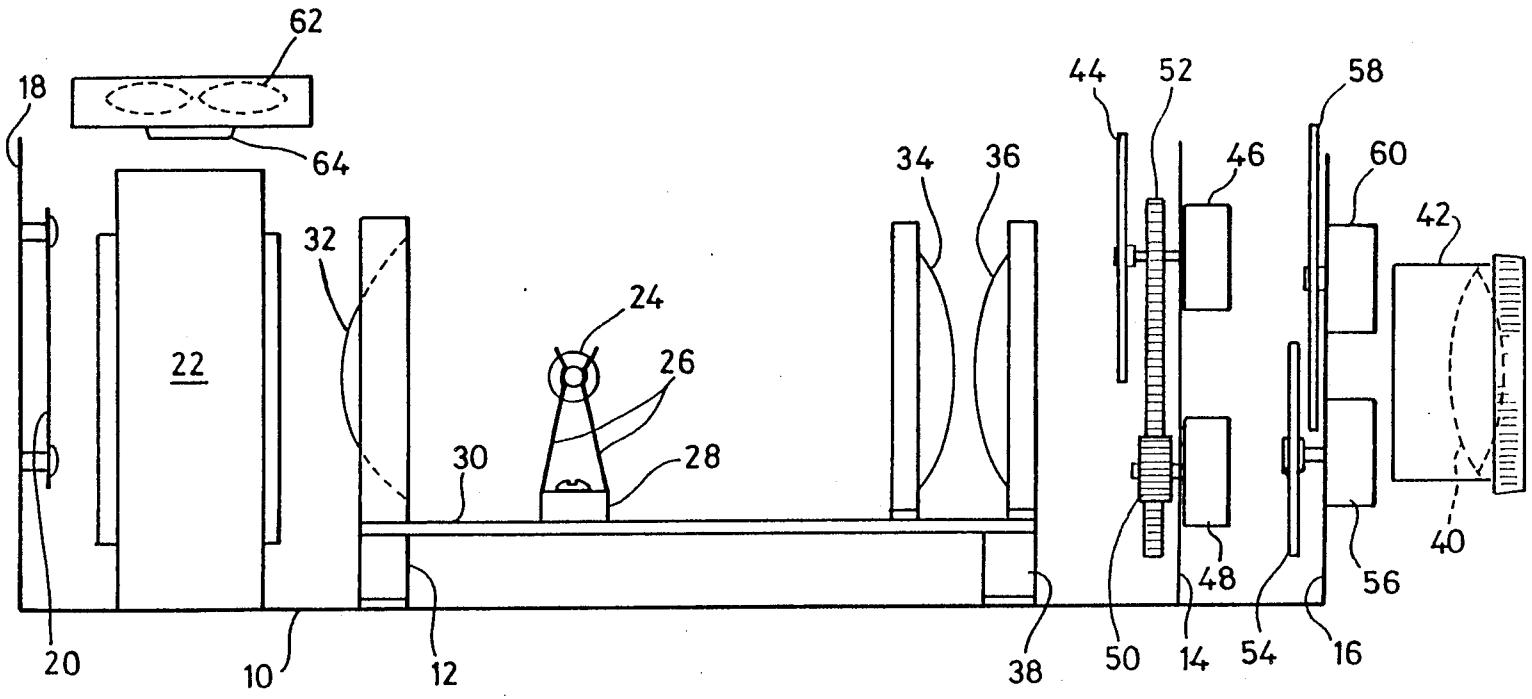
FIG. 1 is a side view of the interior of a spotlamp having internal motorised mechanisms for altering the output from the spotlight.

The internal mechanisim of a spotlamp having various motorised facilities is shown in FIG. 1. The majority of the components are mounted on a baseplate 10 or on upstanding bulkheads which themselves are secured to and extend vertically from the baseplate 10 such as 12, 14 and 16.

From left to right the assembly comprises a back plate 18 on which is mounted on stand offs a printed circuit board 20. A choke 22 is provided for a gas discharge tube 24 supported between two pairs of sprung conductors at each end one pair being shown at 26 which themselves are mounted on an insulating bridge 28. The latter is supported on a platform 30 which extends from the first bulkhead 12. This additionally provides support for a concave mirror 32, typically a parabolic mirror, for focussing light from the lamp 24 towards a pair of condensing lenses 34 and 36 and supported by an extension of the platform 30, which at its front end is carried by a bridge 38 shortly in advance of the bulkhead 14.

A focusing lens 40 is carried in an adjustable mount 42, and between the lens 40 and the lens 36, mounted on the two bulkheads 14 and 16 are four drive motors for rotating different elements which each affect the beam of light which is to be transmitted from the spotlight.

The first rotatable element is a circular disc 44 driven by a motor 46 having a number of circular apertures circularly arranged therearound one of which is a simple circular aperture and the others of which contain different obstructions in the form of patterns to enable the beam to be interrupted and an image of the pattern formed in the final spot of light. Such a wheel is referred to as a Gobo wheel.

Mounted on the same bulkhead 14 is a second motor 48 which drives through a pinion 50 the toothed outer periphery 52 of a rotatable iris diaphram, which can be rotated in one direction to open and in the other direction to generally close a circular aperture defined by the diaphram.

As with all iris diaphrams, it is impossible to shut off the light completely and a further optical element is provided in the form of a disc or part disc 54 carried on the second bulkhead 16 and driveable by a third motor 56. This element includes a circular aperture through which light can pass in an unobstructed manner but also includes a complete shutter section which if rotated into the path of the beam will obscure the beam completely thereby preventing any light from leaving the spotlight. The last rotatable element is a further disc 58 similar to the Gobo wheel 44 having a number of circular apertures therearound one of which is clear but the others of which contain coloured glass or plastics material for producing different colour beams of light. A fourth motor 60 is mounted on the bulkhead 16 so as to drive the colour filter wheel 58.

Since the discharge lamp will produce a considerable amount of heat as may also some of the other components, a cooling fan 62 and drive motor 64 therefor, is mounted to the rear of the housing above the choke.

A typical gas discharge lamp is a Wotan Metallogen type HMI 575 W/GS.

Figure 2:
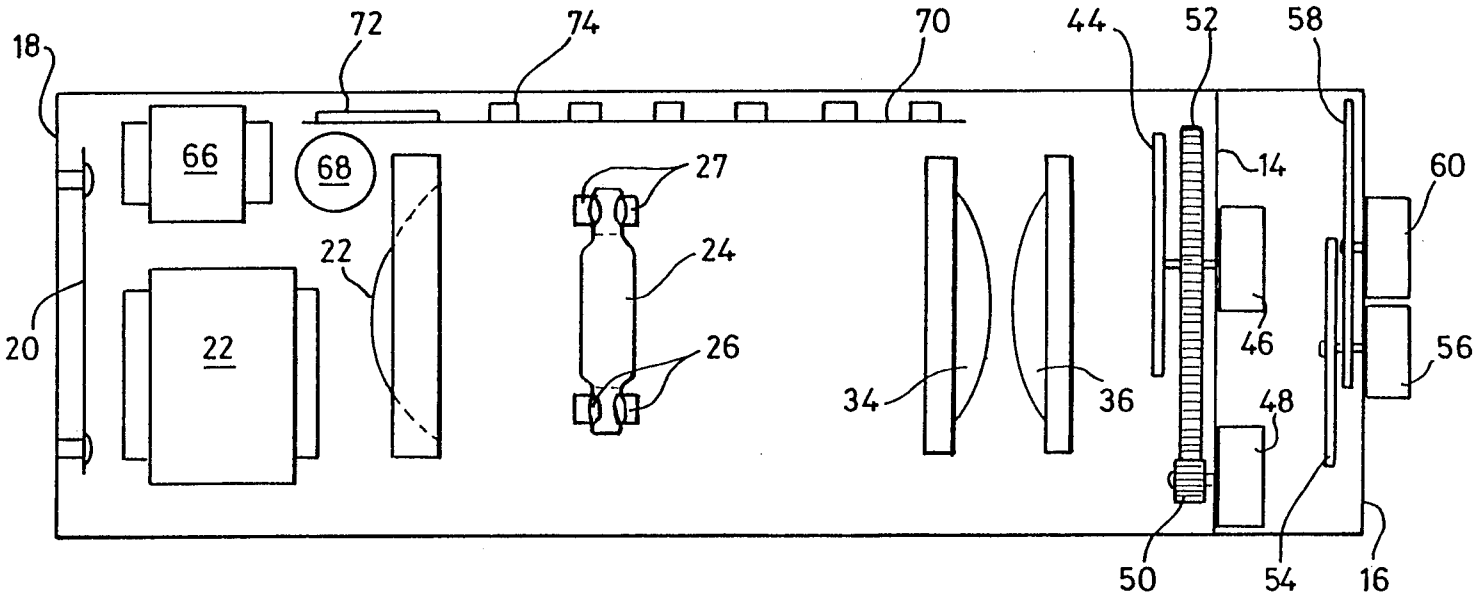
FIG. 2 is a top view of the interior shown in FIG. 1.

FIG. 2 shows the apparatus in FIG. 1 from above and enables a transformer 66 and starter component 68, positioned behind the choke in FIG. 1, to be seen. Additionally a second printed circuit board 70 can be seen on which is mounted a microprocessor 72 and various other components including capacitors such as 74. The same reference numerals have been used in FIG. 2 to identify the components common to the two figures. In this connection the other pair of sprung conductive clips (of which only one pair of 26 can be seen in FIG. 1) are denoted by reference numeral 27 in FIG. 2.

For simplicity the focusing lens mounting 42 and lens 40 are not shown in FIG. 2.

Figure 3:
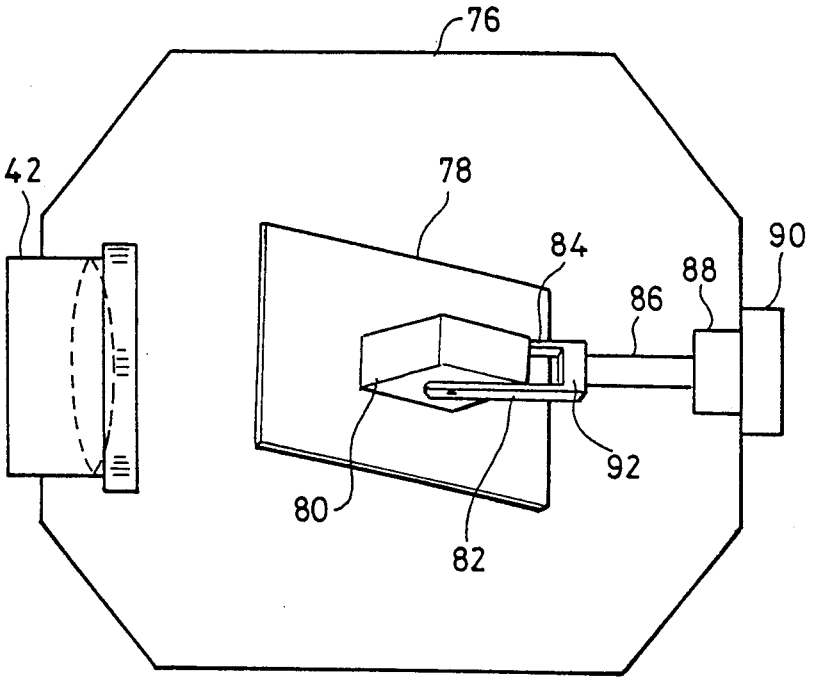
FIG. 3 is a side view of a hood adpated to be mounted on the front of the spotlight to allow the direction to the beam to be changed by motorised control of a mirror.

Reference is made to FIG. 3 for the remainder of the floodlight detail. FIG. 3 shows a housing 76 which is adapted to be mounted at the front of the housing container the base plate 10 with the lens housing 42 protruding into the housing 76.

Within the latter is mounted a plane mirror 78 which centrally at its rear is mounted on one edge face of a generally rectangular motor housing 80, the spindle of which is non-rotatably secured to parallel limbs 82 and 84 of a support, the base of which is attached to a rotatable shaft 86 which protrudes from a bearing assembly 88 carried by the opposite end of the housing from that through which the lens housing 42 extends.

The shaft 86 comprises the output drive shaft of a motor 90 which itself is non-rotatably externally mounted on the end wall of the housing 76.

Rotation of the motor 90 thus causes rotation of the shaft 86 and in turn rotation of the base or bridge 92 from which the limbs 82 and 84 extend. This produces rotation of the mirror (whatever its inclination) about the axis of the shaft 86.

If the motor 80 is powered instead of (or in addition to) motor 90, the mirror is then rotated about the axis of the output shaft of the motor 80, which as will be seen from the drawings, will always be at right angles to the axis of the shaft 86. In this way the inclination of the mirror about the axis of the motor 80 can be controlled and the beam of light emanating from the lens 40 can thereby be reflected to fall on any one of a large number of points as determined by the rotation of the motors 80 and 90.

Figure 4:
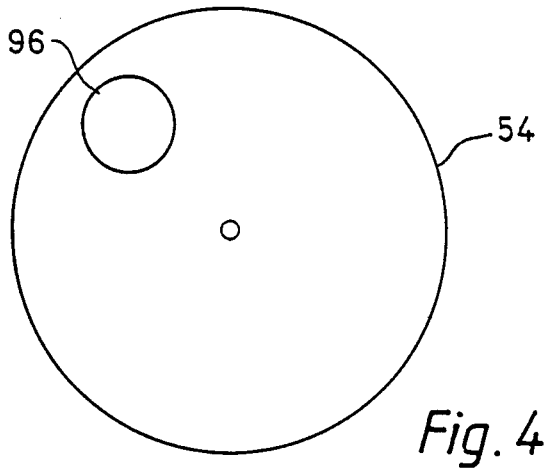
FIG. 4 is a plan view of a shutter which can be rotated so as to completely cut off the light.

FIG. 4 illustrates the shutter disc 54 of FIG. 1. An aperture 96 allows light to pass through in an unrestricted manner provided the aperture has been rotated into the path of the beam between the lens 36 and the lens 40. All other rotational positions of the shutter 54 caused the beam to be cut off.

Figure 5:
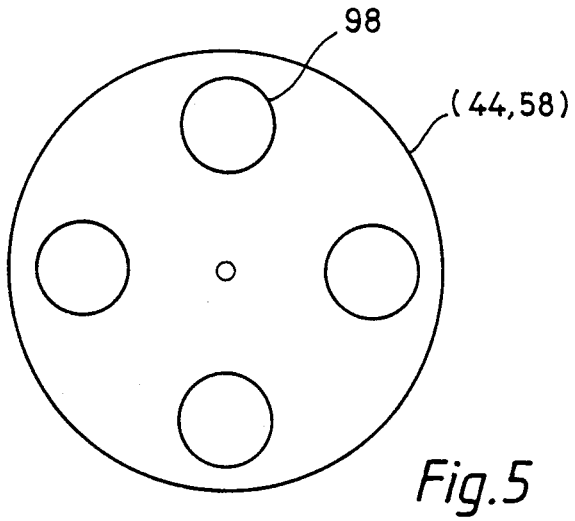
FIG. 5 illustrates the general structure of the so-called Gobo wheel and colour filter wheel incorporated in the spotlight.

FIG. 5 illustrates the construction of the Gobo wheel and the colour filter wheel. Here each wheel includes a circular array of circular apertures, of which one is denoted by reference numeral 98, and in the case of the Gobo wheel the aperture is partly obscured with opaque material defining a pattern such as a star or cross or pattern of small windows through which light can pass. In the case of the filter wheel, each aperture forms a window for a sheet of coloured glass or plastics or other coloured transparent material, so as to colour the beam of light leaving the spotlight. In both cases one of the apertures is left completely open so as to enable the wide spectrum white light from the lamp 24 to pass in an unrestricted manner to the lens 40.

Figure 6:
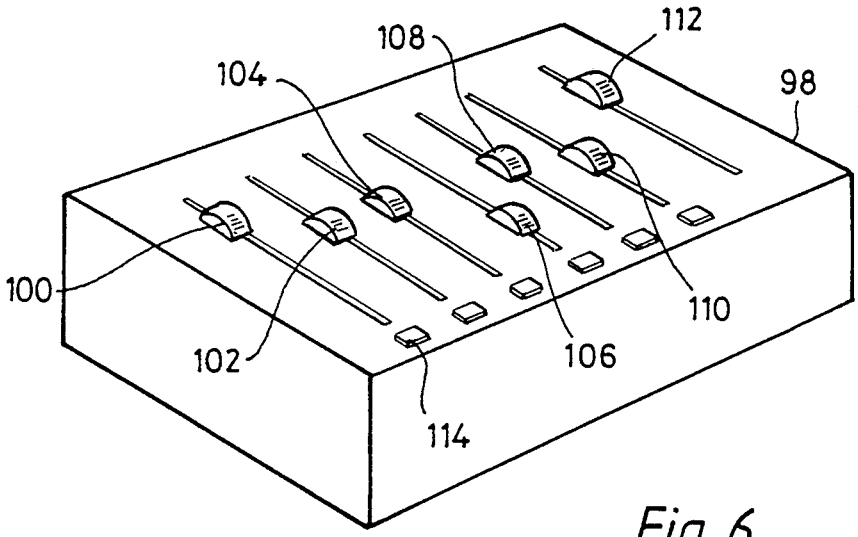
FIG. 6 illustrates a typical mixing desk having six sliding controls and a master control for providing six 0 to 10 volt output signals which hitherto have normally been used to drive faders in a fader bank to control the intensity of six spotlights.

FIG. 6 shows a conventional slider control panel. The housing is denoted by reference numeral 98 and seven linear potentiometers are housed within the housing each having its own independent control 100, 102, 104, 106, 108, 110 and 112 respectively. Each slider is associated with a printed display of numbers ranging from 0 to 10 (or some such similar range) and each of the first six potentiometers 100 to 110, includes a reset button (of which one is denoted by reference numeral 114) by which the current selected value for the potentiometer can be overriden and the full value for that potentiometer transmitted, by merely pressing the appropriate button.

The seventh potentiometer and control 114 is in the form of a master control which will simply increase the signal on all channels from the lowest possible value up to whatever the maximum value is set by the slider associated with each channel, by simply increasing the master potentiometer controller from the 0 setting to the highest setting.

The potentiometers are normally arranged to control the output of six analogue signal outputs which in turn control the value of six fader units which themselves control the supply of power to the lamps in six spotlights. In this mode the dimmer panel shown in FIG. 6 can control the brightness level from six spotlights, but it will be seen provides no signals for controlling any other parameter such as colour or beam position, etc. However large numbers of such dimmer control panels are currently installed in theatres and places of entertainment, and in accordance with the invention it is an object to provide floodlights which can be controlled by such multichannel fader controllers so as to eliminate the need for expensive additional control equipment to be purchased. The difference is that in the case of a lamp such as that shown in FIGS. 1 to 3, the six potentiometers 100 to 110 would in fact control the six functions associated with only one floodlight (assuming the latter has six drives associated with it as shown in FIGS. 1 to 3). Thus in a multichannel control system in which there may for example be sixty linear potentiometers of the type shown in FIG. 6, instead of controlling the intensity of sixty spotlights, the sixty channel control panel can now only control ten spotlights but in addition to controlling the intensity of the light, the control panel will also enable the colour of each beam, the position of each spot, and other parameters.

The invention is not limited to a control producing only analogue signals, one for each channel, but is also capable of responding to a more modern control centre which produces a serial train of data, each packet of information in the train being preceded by a precursor or flag by which the packet can be identified and which will uniquely identify the spotlight which the packet of information is to control. Thus the control panel of FIG. 6 may in fact produce six digital information signals to be transmitted in succession after an appropriate precursor for controlling one spotlight using a single conductor for carrying the data to the spotlight, provided the spotlight includes an appropriate interface for first of all identifying data which is intended for it, and decoding the digital information so as to produce appropriate control signals for the motors and/or other apparatus on board the spotlight.

Figure 7:
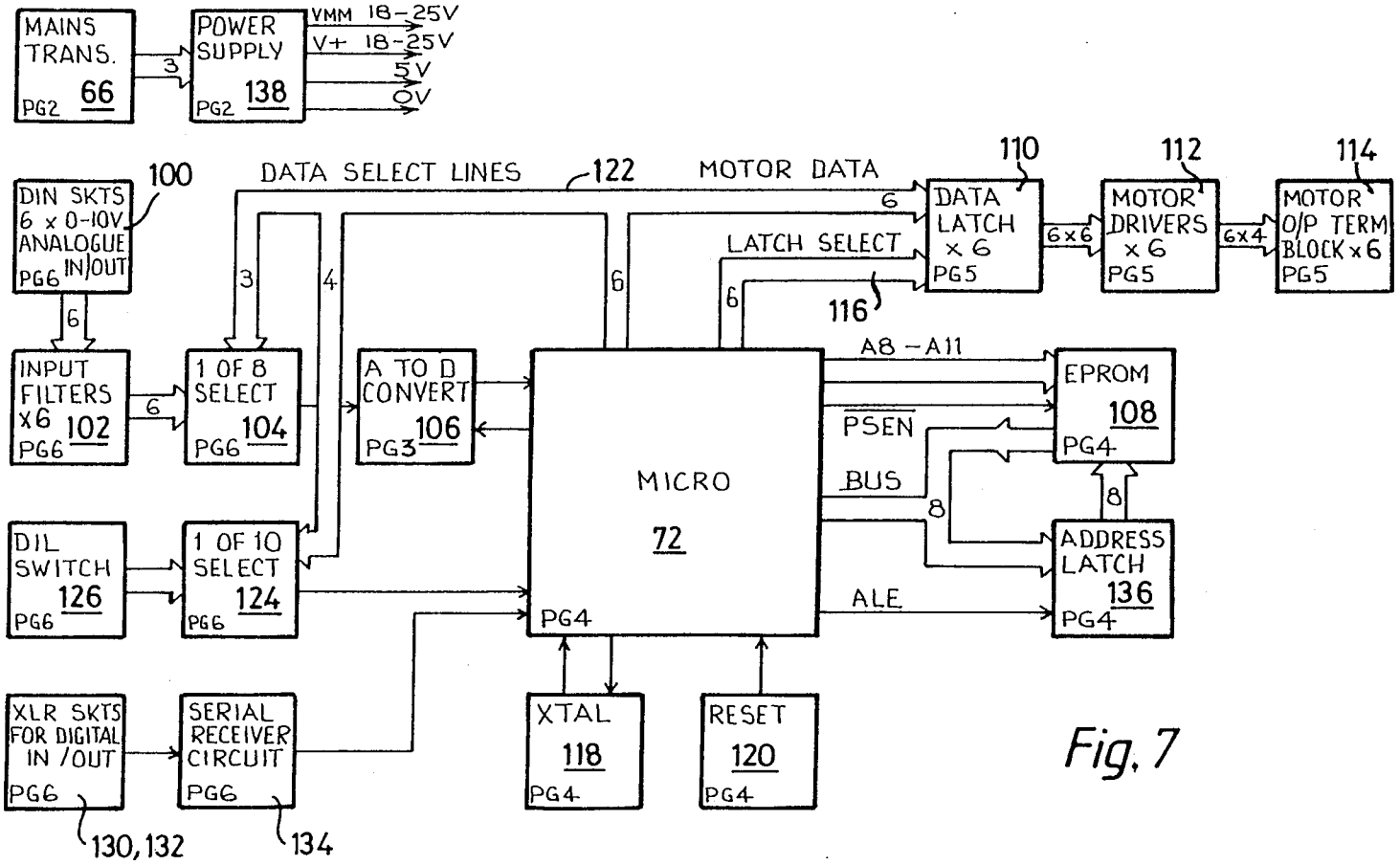
FIG. 7 is a block circuit diagram of the input circuit, control system and output drives for the motorised mechanisims in the spotlight.

FIG. 7 is an over view block circuit diagram of a complete control system suitable for receiving either analogue signals on six channels or digital information in serial form. For simplicity only one motorised drive is shown with control signals being generated for only that one motor drive. In practice six motor drives and motor output terminal blocks will be required.

The control system includes six DIN socket to receive six analogue signals on six different channels. The sockets are denoted by reference numeral 100.

Figure 9:
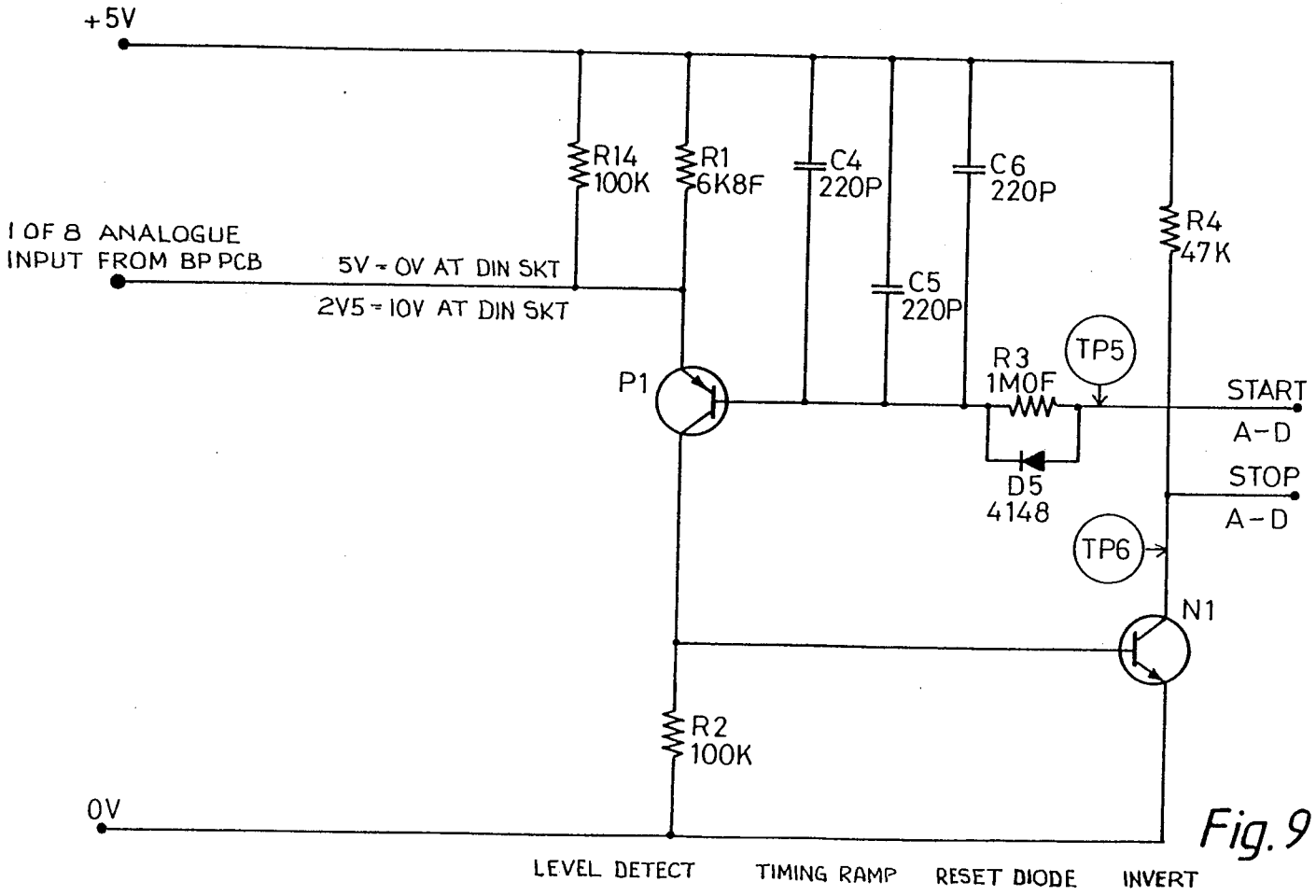
FIG. 9 is an analogue to digital conversion circuit for use with the spotlight.

The outputs from the sockets are filtered by six filter circuits 102 (see FIG. 12), and the filtered outputs are applied to the inputs of an input channel selector. Details of this circuit are also shown on FIG. 12 and will be described later. The channel selector device is denoted by reference numeral 104 and the selected analogue output signal is supplied to an analogue to digital convertor 106 details of which are shown in FIG. 9. The actual function of the analogue to digital convertor involves the use of a counter on board the particular microprocessor integrated circuit selected for this equipment, and as shown in FIG. 7, information is shown transferring from, as well as to, the microprocessor 72.

The latter is programmed by means of a computer programme contained in an EPROM 108 so as to select the data on each of the six lines in sequence so as to control each of six motors and to route the digital information in the form of a series of control pulses for driving a motor via a data latch 110 to the appropriate motor driver 112, and then to the motor output terminal block 114. The microprocessor additionally selects the latches via the data line 116.

The selected microprocessor is controlled by an external crystal oscillator 118 and a voltage source for resetting the microprocessor on turn-on is also provided at 120. Details of both circuits 118 and 120 can be found in FIG. 10.

The programme from the EPROM 108 determines the data select information transmitted via the data highway 122 either to the one of eight selector 104 or the one of ten selector 124, which is manually programmable using a DIL switch 126. The setting of the latter determines the channel information supplied along line 122 to the microprocessor 72.

If instead of analogue signals, the spotlight is to be controlled by serial data, the alternative signals are supplied to one of two XLR sockets 130, (see also FIG. 12). The other similar parallel connected socket 132 serves as a connection for the common serial data bus, to feed the input socket (equivalent to socket 130) on the next spotlight in the chain.

The digital signals are amplified by a receiver and pulse shaping circuit 134, before being supplied to the serial data input port of the processor 72.

The programme stored in EPROM 108 causes the processor 72 to respond to and transmit pulses which follow a precursor set up by the DIL switch 126 and 1 of 10 selector 124. All other incoming serial data is ignored. The six data signals following the identified precursor are decoded by the processor acting in accordance with the EPROM 108 programme, and are transmitted as Motor Data on data highway 122, to the latch 110, and thereafter the motor drivers 112. Any change in the data for any particular motor from the preceding packet of data thus immediately appears as a control signal for the motor concerned to adjust the motor position to that determined by the new data.

The EPROM 108 is addressed in a conventional manner using an address latch 136.

A power supply comprises a mains transformer 66 (see FIG. 2 and FIG. 8) a rectifying and smoothing and regulating circuit 138, to supply the different dc operating voltages for the various circuits making up the control system.

Reference will now be made to the more detailed circuits in FIG. 8 onwards.

Figure 8:
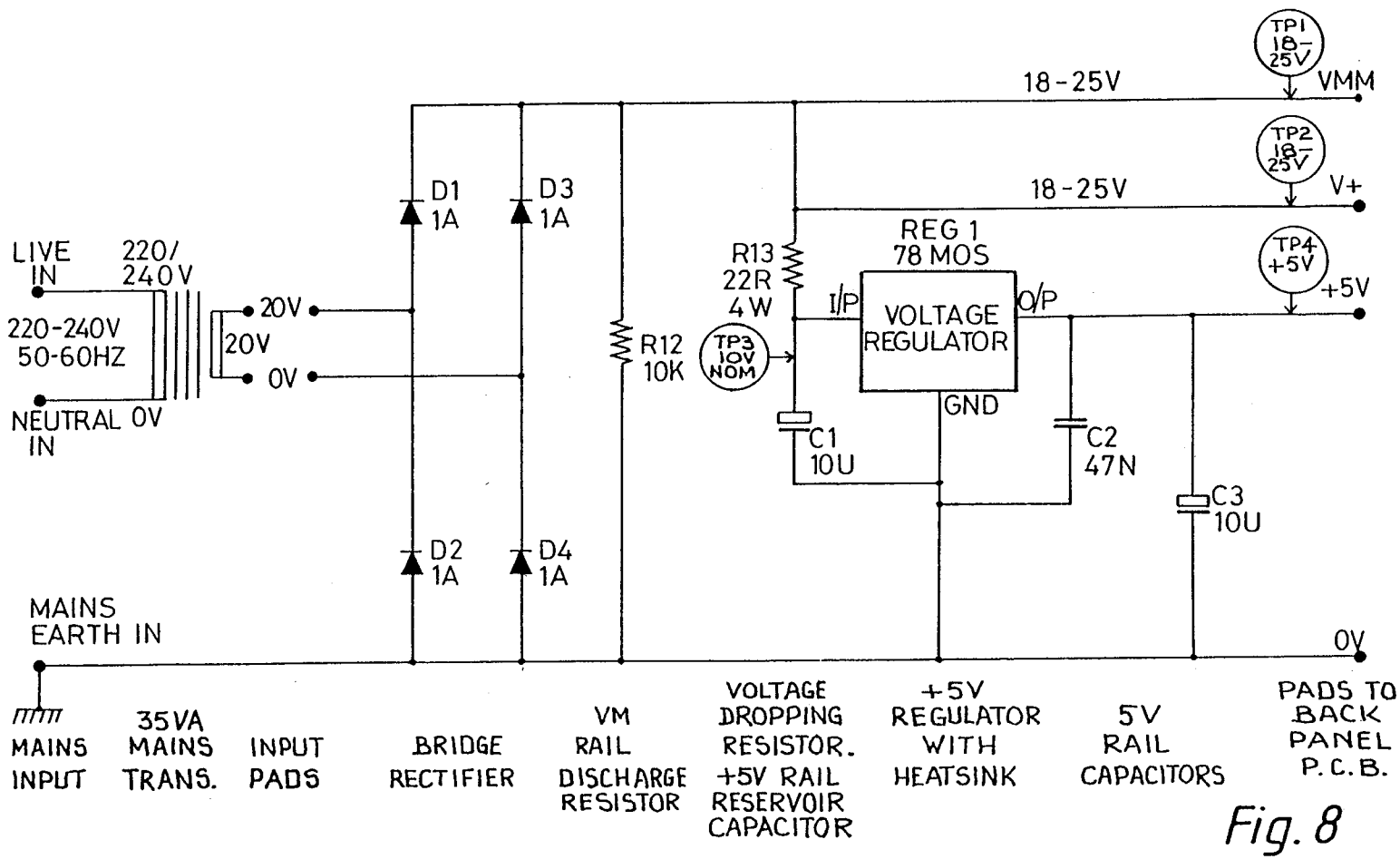
FIG. 8 illustrates the power supply unit for the spotlight.

In FIG. 8 the transformer 66 feeds a full wave bridge rectifying circuit which includes rectifying diodes D1–D4, a discharge resistor R10 and a series voltage dropping resistor R13, smoothing capacitor C1 and C3 and voltage regulator REG1 with feed back capacitor C2.

FIG. 9 must be read in conjunction with FIG. 10, since the A/D converter circuit relies on a counter which produces an overflow signal after a given count value has been reached which is located in the processor 72. The analogue input signal (from the selected incoming line) is supplied to the emitter of P1.

If the incoming analogue signal is at 0 V, the emitter of P1 will be held at 5 V (see the connection via the Input Channel Select IC2 and the d.c. amplifier P2, N2). If the incoming signal is +10 V, the effect of the input attenuators (see FIG. 12) will be to hold the emitter of P1 at 2.5 V.

The value of P1 emitter voltage will determine the time taken from the capacitor C4–C6 to change up and therefore the time interval between the start A/D signal and the stop A/D signal and therefore the number of pulses counted by the counter. The number of pulses will therefore be a measure of the value of the incoming analogue voltage. This is interpretted by the processor and a data stream appropriate to the specific function of that motor is sent to the appropriate motor driver circuit ½ via its data latch 110.

FIG. 10 shows the connections required to the processor IC1, the address latch IC2 and the EPROM IC3. Also shown is the turn-on reset pulse generating of C7, R5 and the crystal X1 and associated capacitors C8, C9 which determine the processor clock frequency. The selected processor is type 80C31 with the latching device by 74HC373. The EPROM may be a 27C16 or 27C64.

FIG. 11 is exemplory of 6 similar circuits each of which is connected to the 01, 02, 03, 05, 06 and 07 output pins of the processor IC1 via the D0, D1, D2, D3, D4 and D5 pins of Data Latch IC4A, which in turn provide the address links 01, 02, 03 and 05 from the switch selectors IC3 and IC4 of FIG. 12 and the 01, 02 and 03 inputs to input channel selector IC2 of FIG. 12.

The Data Latch IC4A is a type 40174 and latched digital data provides to controlling input signal to windings drivers A and B (IC5A and IC6A) each of which is a device type 3717. The currents to the A and B windings of a bipolar stepper motor (not shown) are derived from pins 1 and 15 of each driver device and are connected to the windings via a terminal block.

Each of the motor winding driver circuits such as FIG. 11 includes a large decoupling capacitor 74 typically of 1000 micro farads. One of these six capacitors 74 is identified on the p.c.b. 70 in FIG. 2.

FIG. 12 shows the connections to the pins of the DIL switch 126, the two 4051 devces which enable a 1 from 10 selection to be made, depending on the input of the pins A0, A1, A2 and E. The DIL outputs for supply to the DIL-IN terminal of the processor 72 is obtained from the Z pins of both switch selectors IC3 and IC4. The serial output, for supply to the serial data input of the processor 72, is derived from the output of gate IC1-B (one half of a 4093), the strapped inputs of which are connected to the collector of transistor P1 in the RS232/42 receiver 14.

The analogue signal from the A/D converter is derived from the Z output of selector 124 having the six input channels connected to the Y1–Y6 input pins. Pins Y0 and Y7 are connected to the +5 V and the 0 V lines respectively.

Addressing for the selector 124 is derived from the signals from input pins 01, 02 and 03 of the processor 72. These signals are supplied to the addressing inputs A0, A1 and A2 of selector 124.

Each incoming analogue voltage is attenuated and filtered by the combination of one of the resistors R3–R13, one of the resistors R14–R19 and one of the capacitors C4–C9, to the extent that the voltage across the capacitor C4–C9 is approximately 25% the incoming voltage.

Each of the motors in the spotlight is a bi-polar stepper motor and according to the invention, the normal $200\times1.8°$ steps obtainable is increased by a factor of 4, to 0.45° steps, by further subdividing the currents to the two windings so that between each pair of normal positions of the armature, corresponding to $(I_1,0)$ and $(O,I_2)$ there can be defined two further positions corresponding to $(I_1, \frac{1}{2}I_2)$ and $(\frac{1}{2}I_1, I_2)$.

These intermediate current values can be obtained by appropriate signals from the processor 72 to the drivers (IC5A, IC6A). This allows smoother movement of the driven component to be obtained, and is of benefit to the drives for the mirror.

The 0.45° divisions can if desired be further subdivided by generating signals of proportionately decreasing and increasing duration over a short period of time (being the time which the component is to take to shift through the 0.45° step. Although the component will not be capable of responding to the resulting oscillation which should result, the net effect is to achieve an apparently smooth transition between each pair of 0.45° separated positions. Thus if there are approximately 100 control current pulses being generated per second, the smooth transistion can be achieved during for example 16 successive pulses, if at the outset of the 16 pulse periods the drive current IC to the second winding is increased momentarily to the value required to obtain the full 0.45° step only during the last 1/16th of the internal, and during the next of the 16 internals of the last 2/16ths of the interval, and so on, until during the 16th interval the second winding current is maintained at the value required to obtain the full 0.45° step, for the whole of the period concerned.

Two threshold values are provided in the EPROM programme for comparison with the setting of one of the potentiometers in the multichannel controller so that if the potentiometer slider is within the first 20% of its travel the component motor it controls is driven fully clockwise (say) and within the last 20% of its travel, the component motor is driven immediately to the maximum displacement position in the opposite (anti clockwise) direction. By linking this to the motor 56 which controls the shutter 54 the remainder of the slider travel (ie between the 20% and 80% positions may be used to control an auxilliary circuit for generating control signals for another parameter.

Typically a time delay is built into the programme so that if the slider is moved quickly through the range of values between the 20% and 80% positions the auxillary circuit is not triggered, whereas if the operator slows down the movement of the slider, the dwells for more than a predetermined time on a value between the 20% and 80% position so the system will trigger the auxillary circuit to generate control signals for the motor 56 which will cause the motor to oscillate between its two extreme positions, with the rate of the oscillation (complete swings per second) being controlled by the precise intermediate value at which the slider is positioned. In this way for example, the shutter 54 can be made to oscillate between open and closed positions at up to 25 oscillations per second thereby giving a strobe effect.

The criterion as to whether the second mode of control is to be invoked, is determinable by measuring the rate of change of input value (voltage or digital signal) with time. If this rate of change is slower than a predetermined rate the second mode is enabled whereas if it is above the predetermined rate, the second mode is inhibited.

What is claimed:

1. A spotlight having n adjustable parameters, comprising a housing and, for each adjustable parameter) a bipolar electric stepper motor mounted within the spotlight housing, and wherein there is provided a first control signal input means by which n different analogue electrical signals for the spotlight may be used to control the rotational position of the n different stepper motors, to allow remote control of the n different parameters, a second control signal input means by which a single transmission path carrying control signals as a serial datastream can be connected to the spotlight, and receiver means associated with the second signal input means and adapted only to respond to a precursor of one particular data stream, so that the spotlight may be uniquely addressed from a remote control means, which generates the appropriate precursor and transmits thereafter the requisite data as a serial data stream, thereby to alter one or another or all of the n controllable parameters of the spotlight by using n different channels within the transmitted data.

2. A spotlight according to claim 1, further comprising an interface which includes digital to analogue converter circuit means for generating appropriate analogue signal values from incoming digital data.

3. A spotlight according to claim 1, further comprising analogue to digital converter circuit means for converting incoming analogue signals on n different control channels into digital signals.

4. A spotlight according to claim 1, further comprising selection circuit means whereby if signals are received at both the analogue and serial data input means, for a given parameter drive, the higher value is always selected and employed to determine the rotational position of the particular parameter drive.

5. A spotlight according to claim 1, wherein the analogue signal input range required to obtain the complete range of values of each of the controllable parameters, is a voltage change over a unique voltage range, whereby each parameter drive is controllable by an analogue output over said unique voltage range from a multichannel control console of the type used for controlling the intensity of a corresponding number of conventional spotlights via a bank of dimmers.

6. A spotlight according to claim 1, adapted to be remotely controlled from a console by the transmission of electrical control signals thereto for controlling, inter alia, the movement of a parameter controlling element in the spotlight, from a first position to a second position, the drive for the element being actuated to move the element into the first position at values near to and at one extreme of the possible range of values of the control signal on the channel appropriate to that parameter, and into a second position by values at or near the other extreme of the possible range of values of the control signal for that channel, the spotlight further comprising circuit means within the spotlight to detect intermediate values of the incoming signal and the rate of change of the signal values, thereby to generate a supplementary control signal if during transition through said intermediate range of values the rate of change of value falls below a preselected rate for a preselected period of time, and a drive means in the light is adapted to be responsive to the intermediate values of the incoming control signal only when the said supplementary control signal is generated, whereby that drive means is caused to perform a further controllable function within the spotlight whilst the incoming signal dwells in the said intermediate range of values, depending on the actual intermediate value which is received.

7. A spotlight according to claim 6, wherein the drive means which is rendered responsive to the intermediate signal values is the same drive to which the incoming signal relates, the generation of the supplementary control signal causing the said drive means to perform in a different way.

8. A spotlight according to claim 6, wherein the drive means controlled by the said intermediate values is a separate drive means, for a function differing from that to which the incoming signal relates, and said separate drive means is only energised to perform said function when the supplementary control signal is generated.

9. A spotlight according to claim 7, wherein the parameter controlling element is a shutter which is movable into and out of the path of the beam and in the presence of the supplementary control signal, the shutter drive means is caused to oscillate the shutter between its two extreme positions at a speed determined by the actual intermediate value of the control signal, whereby the spotlight may be made to strobe at a variable strobe frequency determined by the selected value in the intermediate range of values.

10. A spotlight according to claim 1, further comprising, in order that the transistion between two adjacent positions of the armature of a bipolar stepper motor may be smoothed, gating means for gating the changing one of two controlling currents at a high frequency such that there are M gated periods between the first position and the second position, and circuit means for successively increasing the proportion of each gated period during which the changing current is at its new value and thereby decreasing the proportion of each internal during which the changing current is at its initial value so that, if the motor could respond, its armature would perform a series of M oscillations between the first and second positions, with the dwell time at and just after the beginning of the sequence tending towards the first position and the dwell time towards the end of the sequence tending more and more towards the second position.

* * * * *